US005185496A

United States Patent [19]

Nishimura et al.

[11] Patent Number: 5,185,496

[45] Date of Patent: Feb. 9, 1993

[54] ELECTROSTATIC LATENT IMAGE DEVICE HAVING A COATING LAYER PROVIDED ON A DEVELOPER CARRYING MEMBER

[75] Inventors: Katsuhiko Nishimura; Keiji Okano, both of Yokohama; Toshio Miyamoto, Tokyo; Tatsunori Ishiyama, Yokohama, all of Japan

[73] Assignee: Canon Kabushiki Kaisha, Tokyo, Japan

[21] Appl. No.: 664,227

[22] Filed: Mar. 4, 1991

[30] Foreign Application Priority Data

Mar. 2, 1990 [JP] Japan ..... 2-049526
May 18, 1990 [JP] Japan ..... 2-129432

[51] Int. Cl.[5] ..... G03G 15/09

[52] U.S. Cl. ..... 118/658; 355/251; 355/259

[58] Field of Search ..... 118/658, 657, 656, 661; 355/251, 259, 245

[56] References Cited

U.S. PATENT DOCUMENTS 2,221,776 9/1938 Carlson .
2,297,691 4/1939 Carlson .
2,618,552 11/1952 Wise .
2,874,063 2/1959 Greig .
3,666,363 5/1972 Tanaka et al. .
3,909,258 9/1975 Kotz .
4,071,361 1/1978 Marushima .
4,292,387 9/1981 Kanbe et al. ..... 430/102
4,356,245 10/1982 Hosono et al. ..... 430/122
4,387,664 6/1983 Hosono et al. ..... 118/658
4,395,476 7/1983 Kanbe et al. ..... 430/102
4,827,868 5/1989 Tarumi et al. ..... 355/259 X
4,958,193 9/1990 Nojima et al. ..... 355/259
4,967,231 10/1990 Hosoya et al. ..... 355/259 X
4,989,044 1/1991 Nishimura et al. ..... 355/251
4,994,319 2/1991 Nojima et al. ..... 355/259 X

FOREIGN PATENT DOCUMENTS 52-94140 8/1977 Japan .

*Primary Examiner*—Richard L. Moses
*Attorney, Agent, or Firm*—Fitzpatrick, Cella, Harper & Scinto

[57] ABSTRACT

An electrostatic latent image developing apparatus includes a movable developer carrying member for carrying developer to a developing zone where an electrostatic latent image on an image bearing member is developed. There is an outer coating layer on the developer carrying member wherein the coating layer is of resin in which conductive fine particles are dispersed and which is abraded.

86 Claims, 8 Drawing Sheets

ELECTROSTATIC LATENT IMAGE DEVICE HAVING A COATING LAYER PROVIDED ON A DEVELOPER CARRYING MEMBER

FIELD OF THE INVENTION AND RELATED ART

The present invention relates to a developing apparatus for developing an electrostatic latent image formed on an electrophotographic photosensitive member, electrostatic recording dielectric member, or other image bearing member.

Methods of forming an electrostatic latent image are disclosed in U.S. Pat. Nos. 2,297,691, 3,666,363, 4,071,361, for example. The electrostatic latent image image formed on an electrophotographic photosensitive member having a photoconductive material is developed with a developer containing toner. The thus obtained toner image is usually transferred onto a transfer material such as paper, and then is fixed.

Various electrostatic latent image developing machines are known by, for example, U.S. Pat. Nos. 2,874,063, 2,618,552, 2,221,776, 3,909,258, 4,356,245, 4,386,557, 4,292,387, 4,395,476 or Japanese Laid-Open Patent Application No. 94140/1977. FIG. 1 shows an example of image forming machines using the known developing device disclosed in U.S. Pat. No. 4,292,387. On an electrophotographic photosensitive drum rotating in the detection indicated by an arrow, an electrostatic latent image is formed by known electrostatic latent image forming means 20 including a charger and exposure means or the like. The exposure means includes projection means for projecting an optical image of an original or an optical system for projecting a laser beam modulated in accordance with signals modulated in accordance with the image to be recorded.

The latent image formed on the photosensitive member 1 is developed by the developing device 10 into a toner image. The toner image is transferred onto a transfer material by a known transfer means 30 including transfer charger or the like. The transfer material is then fed to a known fixing means after being separated from the photosensitive member 1.

The toner remaining on the photosensitive member after the image transfer operation is removed by known cleaning means including a cleaning blade or the like.

The developing device 10 has a container 12 for containing an insulative one component magnetic developer 11 without carrier particles.

The developer 11 includes insulative magnetic toner, and preferably the developer powder contains fine silica particles. The silica particles are effective to control the triboelectric charge of the toner to increase the image density and to remove the roughness of the image.

For example, it is known that dry silica powder produced by vapor phase method or a. wet silica powder produced by wet method is added to the toner powder. The developer powder containing negatively chargeable toner having styrene acrylic resin and 60 parts by weight of magnetite which is added with dry silica powder exhibiting strong negative charging property (100 $m^2$ of dry silica and 10 parts by weight per 100 $m^2$ silica, are mixed and heated), is suitable for reverse development for developing an electrostatic latent image of the negative polarity.

The developer is discharged from a developer container 12 by a non-magnetic sleeve 14 made of aluminum or stainless steel and rotating in the direction of an arrow A, and is carried thereon to the developing zone 13, where the minimum clearance between the drum 1 and the sleeve 14 is 50–500 microns, for example, 300 microns. In the developing zone, the developer is supplied to the electrostatic latent image, so that it is developed.

The thickness of the developer layer 11' supplied to the developing zone is regulated by a blade 16, which is made of iron or another magnetic material. It is disposed across the sleeve 14 from a magnetic pole N1 of a magnet 14. The magnetic lines of force from the magnetic pole N1 is concentrated on the blade 16, by which a strong magnetic curtain is formed between the blade 16 and the sleeve 14. The magnetic curtain functions to form a thin layer 11' of the developer having a thickness smaller than the clearance between the blade 16 and the sleeve 14 (U.S. Pat. No. 4,387,664). The clearance between the blade 16 and the sleeve 14 is so selected that the thickness of the developer layer 11' is smaller than the minimum clearance between the sleeve 14 and the drum 1, in the developing zone.

For example, the clearance between the blade 16 and the sleeve 14 is 250 microns. In this manner, a so-called non-contact developing action occurs in the FIG. 1 apparatus. Since the thickness of the developer layer 11' carried to the developing zone 13 is smaller than the minimum clearance between the sleeve 14 and the drum 1, the developer particles transfer through the air gap to the drum 1. In order to provide higher efficiency and high density and sharp image without foggy background, the sleeve 14 is supplied with a bias voltage containing AC component from a voltage source 18, as disclosed in U.S. Pat. No. 4,292,387. The waveform of the bias voltage is preferably a waveform obtained by biasing an AC voltage with a DC voltage. The light portion potential and the dark portion potential are between the maximum and minimum levels of the bias voltage, preferably. In addition, it is also preferable that the DC bias voltage level is between the light portion potential and the dark portion potential of the latent image. The frequency of the bias voltage is 1–2 KHz; the peak-to-peak voltage (the difference between the maximum level and the minimum level of the voltage) is 1.1–1.8 KV, approximately, preferably. The waveform is rectangular sine wave or triangular. Because of such a bias voltage, the developer is alternately subjected to an electric field tending to move the developer from the sleeve 14 to the drum 1 and an electric field in the opposite direction, that is, from the drum 1 to the sleeve 14. Thus, good developed images can be provided. For example, when a reverse development is carried out with a negatively charged toner to develop a latent image having a dark portion potential of −700 V and a light portion potential of −100 V, the bias voltage includes a DC component of −500 V and an AC component having a peak-to-peak voltage of 1.8 KV and a frequency of 1.8 KHz and a rectangular waveform. Here, the reverse development means the development wherein the light potential region of the latent image receives the developer charged to the same polarity as the latent image. A regular development means the development in which the dark potential region of the latent image receives the toner charged to the polarity opposite to the latent image.

The developer is charged to a polarity suitable for developing the latent image mainly by friction with the sleeve 14. The developer 11, for example, comprises binder resin material mainly comprising styrene-acrylic copolymer, 60% by weight of magnetite and 1% by weight of methyl complex of monoazo dye as negative charge control agent. The volume resistivity is approximately $10^{13}$ ohm-cm. The developer is an insulative and magnetic developer. Such developer powder is added, for the purpose of enhancing the flowability, with 0.4% by weight, relative to the toner, hydrophobic silica fine particles. The developer is negatively charged by the friction with the sleeve 14 described in the foregoing embodiment or the sleeve according to an embodiment of the present invention which will be described hereinafter.

The magnet 15 has a magnetic pole S1 to form a magnetic field in the developing zone to prevent the production of the foggy background, thus providing clear line images. It also has magnetic poles N2 and S2 to permit conveyance of the developer on the sleeve.

The developer on the developing sleeve is not consumed in the region which is faced to the non-image-area of the photosensitive member. If the non-consuming state continues for a long period of time, fine developer particles are strongly attracted to such an area, probably due to the electrostatic mirror force to such an extent that the toner in that area is not easily transferred to the image region of the image tearing member. In addition, the electric charge amount of the developer on the fine developer is decreased. This may result in production of a ghost image on the developed image. This deteriorates the image quality.

FIG. 2 shows an example of the ghost image. In FIG. 2, a region (a) is the region where the background of the image continued, and thereafter, an image is developed; a region (b) is the region where the image portion continued, and thereafter, an image was developed. It will be understood, that the image density in the region (b) is higher than that in the region (a).

The mechanism of the ghost image production, according to the experiments and investigations made by the inventors, has a lot to do with the layer of fine particles (mainly comprising the toner particles of the particle size 4 microns or less which is fairly smaller than normal particles) on the developing sleeve. The particle size of the developer in the bottom layer on the developing sleeve is different between the developer consumed portion and the developer non-consumed portion. In the non-consumed portion, a developer layer of the fine particles are formed as the bottom layer on the developing sleeve. Such fine particles have large surface areas per unit volume, and therefore, the amount of triboelectric charge per unit weight is large as compared with the particles having large particle size. Therefore, the fine particles are strongly attracted to the developing sleeve by electric force, more particularly, the mirror force due to the electric charge of the fine particles themselves. Therefore, the developer on the fine particle layer is not sufficiently triboelectrically charged by the developing sleeve surface with the result of insufficient triboelectric charge. This causes the ghost image (the image density is locally low) on the developed image.

The sleeve ghost of this type is more remarkable when the used toner has a small average particle size (equal to or less than 9 microns).

Particularly in the case of a one component magnetic developer, there is a tendency that the quantity of the magnetic material in each of the fine toner particles is smaller than that of the proper particle size toner. Therefore, the electric charge amount per unit weight of the fine toner particles is larger than that of the proper particle size toner, so that the attraction by the mirror force to the developing sleeve is strong with the result of more remarkable production of the ghost image. The problem of the ghost image has been solved by the proposal disclosed in U.S. Ser. No. 07/341,352, issued Jan. 29, 1991 as U.S. Pat. No. 4,989,044. In this proposal, the developing sleeve is coated with resin material in which fine conductive particles such as fine carbon particles and/or fine graphite particles. excessive electric charge of the fine particles is removed by leak site formed by the resin material and the fine conductive particles, by which the mirror force of the fine particle toner relative to the sleeve is weakened. This is effective to prevent the above-described ghost image production.

The proposed method is effective to prevent the ghost image, but it has recently been found that it is difficult to further increase the density of the image. It is considered that this is because the function of the leak site is so strong that the electric charge is removed from the proper particle size toner to a substantial extent, thus preventing the increase of the electric charge of the entire developer layer.

Another problem with the proposal is a fading phenomenon as shown in FIG. 3.

For example, when 20 sheets having character patterns at approximately print duty of 4%, low density stripes have been produced, and when a solid black image (c) is printed thereafter, the resultant image has low density stripes (d), as shown in FIG. 3.

When this phenomenon occurs, the developing sleeve has been carefully checked, and it has been found that the toner layer is substantially uniformly formed on the developing sleeve. Therefore, the above-described phenomenon is not due to the local insufficient toner supply to the developing sleeve. Then, the toner in the region (d) on the developing sleeve has been sampled, and the charge amount thereof has been measured, and it has been found that it is lower than the normal level. The toner particles having the smaller amount of electric charge are not easily consumed in the developing action because of the difficulty in transferring through the air gap. This is considered as being the reason for the occurrence of the low image density portions (d) in FIG. 3. Additionally, the surface of the sleeve used in the proposal is so roughened that an extremely great number of sharp and fine projections. The conveying force with the aid of friction by such a roughened surface is strong. Therefore, it can convey against the confining force by the blade 14 the developer layer having relatively a large part of low charge developer which has weaker mirror force relative to the sleeve. Therefore, that part of the developer layer which has the normal charge amount and has relatively strong mirror force, and that part of the developer layer which has weaker mirror force, are conveyed to the developing zone with the similar thickness. These are the reasons why the fading occurs.

SUMMARY OF THE INVENTION

Accordingly, it is a principal object of the present invention to provide a developing apparatus in which the ghost image production is effectively suppressed.

It is another object of the present invention to provide a developing device in which the production of the ghost image can be effectively suppressed, and a high image density can be provided.

It is a further object of the present invention to provide a developing apparatus wherein the production of the ghost image and the fading can be effectively prevented.

It is a yet further object of the present invention to provide a developing apparatus wherein the ghost image production and the fading can be prevented, and high density of the developed image can be provided.

According to an embodiment of the present invention, the developer carrying member in the developing apparatus according to this invention has a resin coating layer having fine conductive particles. The conductive fine particles provide leak site of the electric charge of the developer.

According to an aspect of the present invention, the outer coating layer is abraded, by which the outer coating layer is provided with moderate charge leak site. Therefore, the extreme removal of the electric charge of the developer can be prevented. Accordingly, the high density images can be produced without production of the ghost image.

According to a further aspect of the present invention, the surface of the outer coating layer is so roughened that the cutting depth is 5 microns or less at the positions where a profile bearing length ratio is 5% in a bearing ratio curve, that is, an Abbot-Firestone curve. In such a roughened surface, the number of sharp fine projections is small. Therefore, the conveying force is weak for the low charge developer which is not easily electrostatically attached to the developer carrying member. In other words, the developer having proper charge amount is mainly conveyed. Therefore, the fading as well as the ghost image is suppressed.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
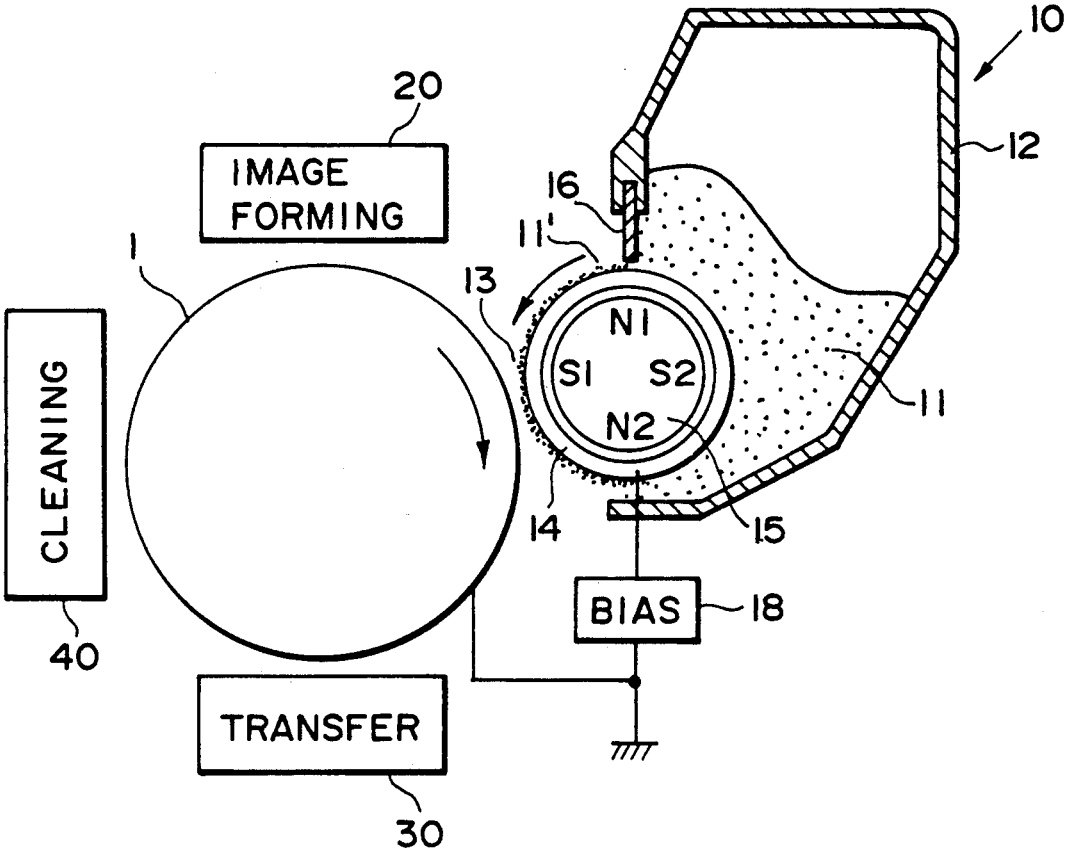
FIG. 1 is a sectional view of a developing apparatus not using the present invention.
Figure 4:
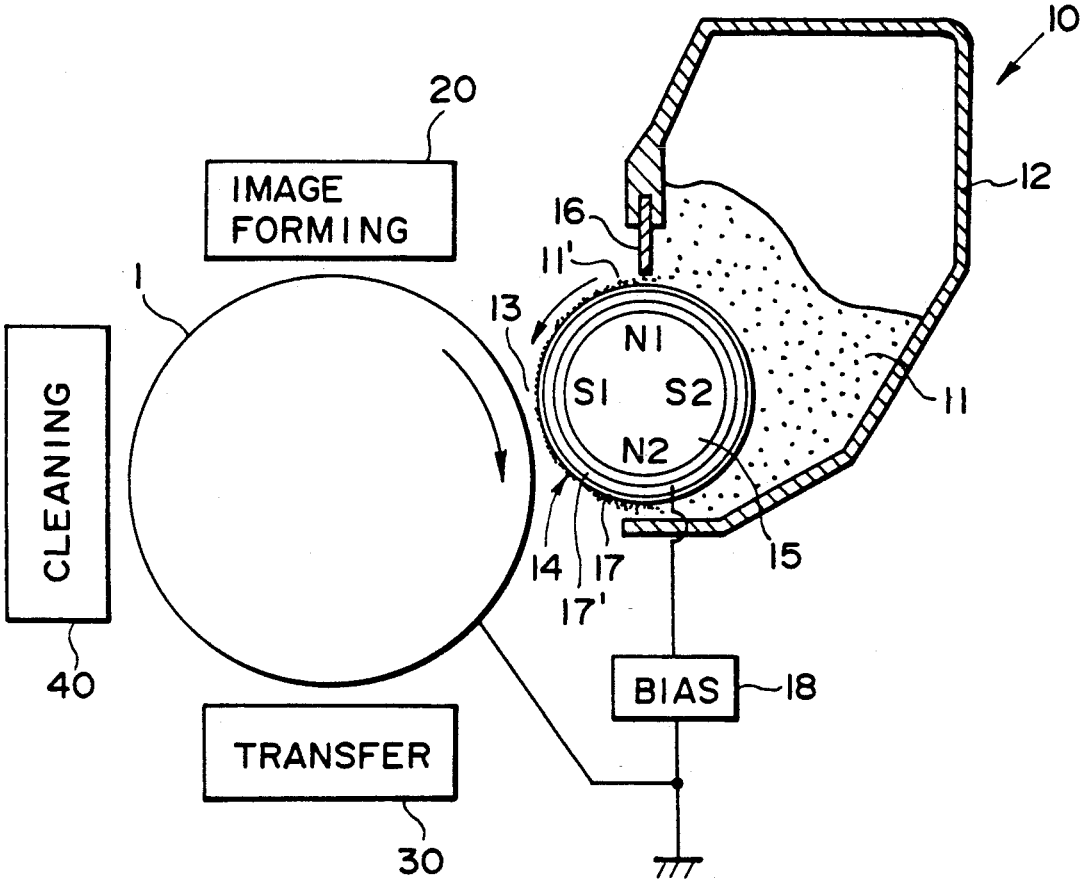
FIG. 4 is a sectional view of a developing apparatus according to an embodiment of the present invention.

The preferred embodiment will be first described in conjunction with FIG. 4, wherein the same reference numerals as in FIG. 1 have been assigned to the elements having the corresponding functions for simplicity.

The apparatus of FIG. 4 has a sleeve 14 comprising a sleeve base 17' of aluminum or stainless steel and an outer coating layer 17 thereon. The outer coating layer 17 is a resin layer in which conductive fine particles are dispersed. The outer coating layer 17 has a volume resistivity which is not more than $10^2$ ohm-cm and not less than $10^{-3}$ ohm-cm, preferably. The thickness of the outer coating layer 17 is preferably not less than 1 micron and not more than 30 microns. In order to assure the proper frictional force for the purpose of conveyance of the developer, the surface of the coating layer preferably has a surface roughness Ra of not less than 0.4 micron and not more than 3 microns (a central average surface roughness Ra is determined in accordance with JIS B-0601).

The fine conductive particles are of carbon black and/or graphite. The graphite has a function of solid lubricant, it is effective to prevent contamination of the sleeve surface with the fine toner powder or some contents of toner. It is also preferable to add in addition to the fine conductive particles solid lubricant material (non-conductive) such as molibdenum disulfide.

The embodiment will be described in detail. In this embodiment, the sleeve base 17' is a drawn aluminum pipe having the surface roughness of 2S. Alternatively, however, aluminum pipe machined to a mirror surface is usable as the base 17'. In addition, stainless steel or another metal pipes are usable.

EXAMPLE 1

The following resin liquid was applied to the aluminum pipe:

| | | |
|---|---|---|
| Resin: | phenol resin (binder) | 30 parts by weight |
| Carbon: | CONDUCTEX 975 UB (available from Columbian Carbon) | 25 parts by weight |
| Diluent: | methyl alcohol<br>methylcellosolve | 200 parts by weight |

The phenol resin was dried in a drying furnace at 150 ° C. for 30 minutes for curing it by heat. The volume resistivity of the resin layer made of PET (polyethylene terephthalate) under the same conditions was $1\times10^{-1}$ ohm.cm$-8\times10^{-1}$ ohm-cm.

Subsequently, the surface of the resin layer was sandblasted (abraded) to remove the sharp fine projections on the surface. The blasting was carried out by a blasting machine available from Kabushiki Kaisha Fuji Seisakusho, Japan. The nozzle is type 3 (having a diameter of approximately 6 mm). The blasting conditions were:

Pressure: 3.5 kg/cm$^2$

Period: 30 sec.

The sleeve 14 having the diameter of 16 mm and a length of approximately 240 microns and coated with the resin was blasted. The used blasting particles were Morumdum A #400 (Arandum particles) available from Showa Denko Kabushiki Kaisha, Japan.

If desired, after the sandblasting, the sleeve may be subjected to the air blowing or cleaning with alcohol.

The developing sleeve 14 thus produced was incorporated in the developing apparatus of FIG. 4, it was confirmed that the ghost image was practically negligible, with the solid black density 1.45, 5 mm square density (the image density of 5 mm×5 mm square image) of 1.50.

Table 1 shows the comparison between the developing sleeve A of this example and the developing sleeve B which was produced by spraying the aluminum tube with the resin liquid and drying it with heat.

TABLE 1

| | Solid black density | 5 mm × 5 mm image density | Ra | Rmax |
|---|---|---|---|---|
| (A) | 1.45 | 1.50 | 0.7 μm | 5.963 μm |
| (B) | 1.30 | 1.35 | 0.8 μm | 8.213 μm |

It will be understood from Table 1, the surface roughnesses (center line average roughness) Ra are substantially the same, 0.7–0.8 micron, but the solid black image densities and the 5 mm×5 mm image densities are different. More particularly, the sleeve A provides the higher image density.

The difference between the sleeve A and the sleeve B is also seen in Rmax. This is because the surface of the developing sleeve 14 in the Example 1 is blasted, and therefore, the fine configuration on the coating surface is suppressed to a significant extent, as compared with the conventional sleeve B, and a slight part of the surface resin is removed. Here, "Rmax" is the maximum roughness in a reference length of 2.5 mm, that is, the height difference between the maximum projection and the minimum pit.

Figure 5:
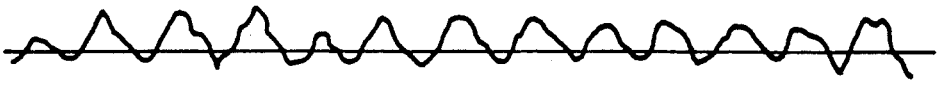
FIG. 5 is an enlarged view showing profiles of the outer coating surface of a sleeve according to an embodiment of the present invention.
Figure 6:
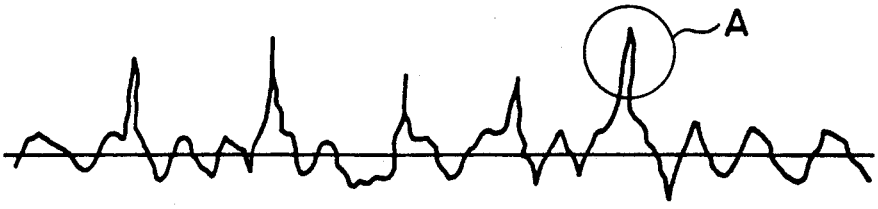
FIG. 6 PRIOR ART
FIG. 6 is an enlarged view showing a profile of an example of an outer coating surface of a conventional developing sleeve.

FIGS. 5 and 6 show the difference in the surface configuration of the sleeves A and B. FIG. 5 is a microscopic enlarged sectional view of the surface of the developing sleeve A, and FIG. 6 shows that of the developing sleeve B produced by spray and drying only.

As will be understood from FIG. 5, the developing sleeve A hardly has sharp peaks, whereas the sleeve B has a great number of sharp peaks A as shown in FIG. 6.

The conductive particle dispersed resin layer 17 is effective to lower the specific electric charge (amount of electric charge per unit weight) of the developer coated thereon.

However, the image density by the sleeve B (Table 1) is low because the surface of the developing sleeve has an extremely great number of sharp peaks A, as shown in FIG. 6, so that the discharging function for removing the electric charge of the developer is too strong with the result that the specific charge amount of the developer is too low. The electric charge amount of the developer on the sleeve B was approximately three fourths of that of the sleeve A.

Using the layer 17 in which most of the sharp projections are removed, as shown in FIG. 5, both of the proper developer conveying force and the specific charge amount control of the developer can be accomplished.

In the blasting abrasion, blasting particles A#80, A#120, A#220, A#300, A#320, A#600, FGB#100 and GB#400 or the like were used. All of them showed good results, namely the higher image density was provided than when the sleeve has the outer coating layer produced by spray and drying only, even if the surfaces roughness Ra were equivalent.

Here, the FGB particles available from Kabushiki Kaisha Fuji Seisakusho are of glass beads which are substantially spherical. Therefore, the blasting with these particles provides a roughened surface having spherical concave pits on the developing sleeve 14.

Figure 7:
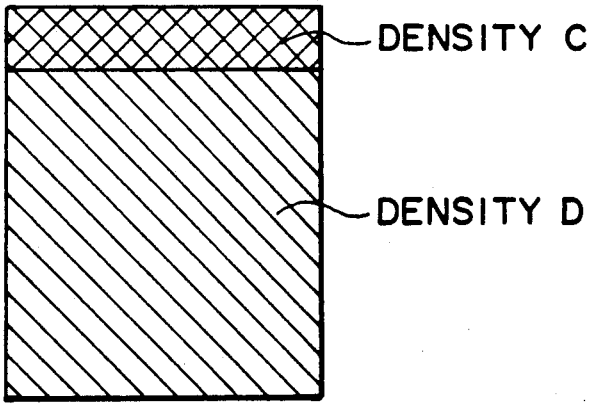
FIG. 7 illustrates an image density difference.
Figure 8:
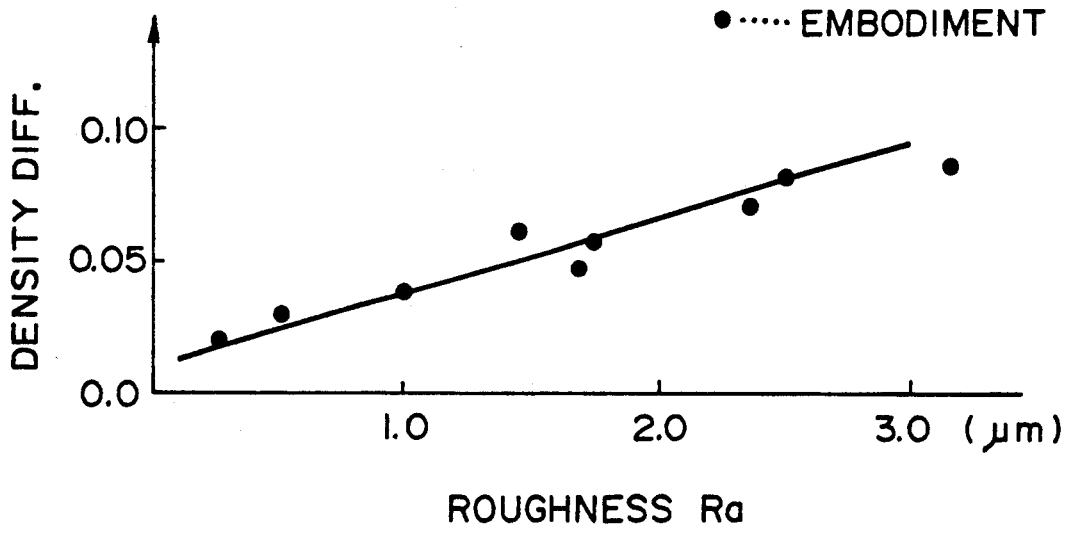
FIG. 8 is a graph of an image density difference vs. outer coating layer surface roughness.
Figure 9:
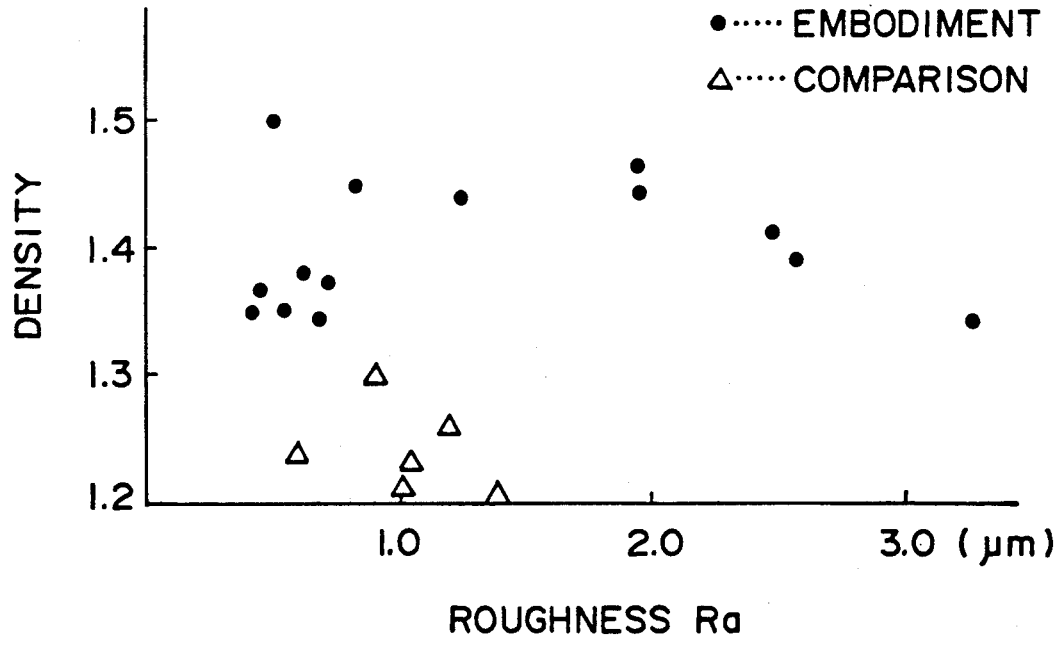
FIG. 9 is a graph of image density vs. outer coating surface layer roughness.

Investigations have been made as to the density difference (|density D−density C|) when the image is developed using the sleeve having the outer coating layer 17 having been blast-treated using the abrasive blasting particles, as shown in FIG. 7, where the density C is the image density provided by an initial one turn of the sleeve after the start of the developing operation; the density D is the density in the subsequent operation, wherein the density C is higher than the density D. As a result, as shown in FIG. 8, the density difference increases with increase of the surface roughness, however, as shown in FIG. 9, as compared with the developing sleeve (comparison example) produced by spraying and drying the resin to form the outer coating layer, the developing sleeve of this embodiment provides a fairly high density in the developed image. The surface roughness of the developing sleeve in these experiments, are 0.3–3.3 microns (Ra).

EXAMPLE 2

In Example 2, carbon black and graphite fine particles were used as the conductive fine particles to be dispersed in the resin layer. The resin liquid was as follows:

| | | |
|---|---|---|
| Resin: | phenol resin (binder) | 30 parts by weight |
| Carbon: | CONDUCTEX 975 UB (available from Columbia Carbon) | 15 parts by weight |
| Conductive solid lubricant: | artificial graphite (average particle size of 7 microns) | 15 parts by weight |
| Diluent: | methyl alcohol methylcellosolve | 225 parts by weight |

The resin liquid is applied on the aluminum tube and dried to be cured, as in Example 1. The sandblasting was imparted similarly to the Example 1. The volume resistivity of the resin layer produced under the same conditions but using PET, was $1\times10^{-1}$ ohm-cm $-8\times10^{1}$ ohm-cm.

When the sleeve of this Example 2 was used, the developed image is substantially free from the ghost image and with the high density similarly to Example 1.

Since, in Example 2, the fine graphite particles functioning as solid lubricant are dispersed in the outer coating layer, the contamination with the fine powder toner and/or the toner resin component is further easily removed from the sleeve surface. Therefore, the ghost image preventing effect is better than that of the sleeve of Example 1.

The average particle size of the graphite fine particles mixed into the outer coating layer is changed in the range between 0.3–7.0 microns. Good results have been provided in any of the sizes.

The weight ratio of the carbon black and the graphite fine particles is not limited to that of Example 2. The ratio carbon/graphite was changed in the range 1/9-9/1, and was confirmed that the good high density images were provided as in the first Embodiment 1.

By controlling the ratio of the carbon to the graphite, the slipping property of the outer coating layer 17 can be controlled. More particularly, with the increase of the content of the graphite, the slipping property is enhanced. This is effective to further improve the ghost prevention effect and the fading preventing effect.

EXAMPLE 3

In Example 3, only the graphite was dispersed in the resin layer 17.

The resin liquid was as follows:

| | | |
|---|---|---|
| Resin: | phenol resin (binder) | 15 parts by weight |
| Conductive solid lubricant: | artificial graphite (average particle size of 1 micron) | 15 parts by weight |
| Diluent: | methylalcohol (methylcellosolve) | 225 parts by weight |

The resin liquid was sprayed on the aluminum tube and dried and cured, similarly to Example 1. Thereafter, the sandblasting was carried out, similarly to Example 1.

Images were developed using the sleeve. It has been confirmed that the production of the ghost image is prevented, and high density images are formed, similarly to Example 1. The particle size of the graphite was changed in the range 0.3-7 microns, using artificial and natural graphite. It has been confirmed that they are all effective.

EXAMPLE 4

In this Example, the resin layer 17 was formed using insulative solid lubricant particles other than graphite. The resin liquid was:

| | | |
|---|---|---|
| Resin: | phenol resin (binder) | 15 parts by weight |
| Carbon: | CONDUCTEX 975 UB (available from Columbia Carbon) | 15 parts by weight |
| Solid lubricant: | molybdenum disulfide | 5 parts by weight |
| Diluent: | methylalcohol methylcellosolve | 225 parts by weight |

The resin liquid was sprayed, dried and cured on the aluminum tube, similarly to Example 1, and the blasting was carried out, similarly to Example 1. The developed image using such a sleeve did not have the ghost image, and had high image density as in Example 1.

The volume resistivity of the resin layer produced under the same conditions but using PET (polyethylene terephthalate) was $2\times10^0$ ohm-cm $-1\times10^2$ ohm-cm.

It has been confirmed that the insulative solid lubricant may be boron nitride.

The present invention is particularly effective with a developing apparatus using the developer having fine toner particles, for example, the toner having the average particle size not more than 9 microns, for example, 6 microns.

Where the average particle size of the developer is small, the specific charge amount of the developer increases, with the increased possibility that the ghost image is produced and that the developer is extremely charged up. Simultaneously, the number of contacts between the toner and the developing sleeve 15 or the developer regulating member 16, with the result of difficulty in obtaining uniform specific charge amount.

When the developer regulating member 16 is of iron plate, the developer is coagulated due to the non-uniformity of the charge at the position of the regulating member 16. If this occurs, the developer is not applied uniformly as the thin layer on the developing sleeve 14, with the result of linear patterns on the developing sleeve. This is not observed in the commercial electrophotographic machines using the developer having the average particle size of not less than 9 microns, usually.

The present invention is effective to provide solution to such problems.

In the foregoing Examples, the blasting has been used to remove the part of the resin and to correct the surface toughness, Alternative methods include rubbing the resin layer with an abrasive member not containing abrasive particles, such as felt, cloth, paper waste, blush or fur skin to remove the unnecessary part of the surface resin and to control the surface roughness configuration, so that the same advantageous effects as in the present invention are provided. Other mechanical abrasion is usable.

In the foregoing embodiment, an AC component of the bias voltage applied to the sleeve ;4 of FIG. 4 has a peak-to-peak voltage of 1.6 KV, the frequency of 1.8 KHz, while the clearance between the drum 1 and the sleeve 14 is 300 microns. The other values are usable.

It has been found that the above-described fading can be prevented if the developing sleeve has the outer coating layer abraded.

As described in the foregoing, the fading occurs frequently where the sleeve has the strong conveying property for the developer. On the other hand, from the standpoint of the proper triboelectric charge of the developer and the uniformity of the developer layer, it is preferable that the surface roughness Ra (center line average roughness) is not less than 0.4 micron and not more than 3.0 microns.

However, even if the roughness Ra was minimum within this range, namely, if the developer conveying force due to the friction force was minimum, the fading is not generally prevented. For example, when the sleeve was produced by applying, drying and curing the resin liquid on the sleeve base, only, the fading occurred even if the roughness Ra was close to the smaller limit of the above range. This is because, the surface of the outer coating layer of the sleeve has a great number of sharp projections, as schematically shown in FIG. 10A, which enhances the conveying force with the aid of friction. Therefore, the level of the surface roughness Ra does not correspond to the degree of the fading preventing effect.

However, even if the roughness Ra is similar to that of the roughened surface shown in FIG. 10A, the fading can be significantly suppressed if the surface is as shown in FIG. 10B, as has been found by the inventors. More particularly, the fading can be prevented if the end of the fine projections are not sharp, that is, the surface does not have the sharp projections, as shown in FIG. 6A, the number of sharp projections, if any, is small as shown in FIG. 5. Various investigations have been made by the inventors as to the profile of the surface of the outer coating layer 17 which can prevent the fading.

The degree of the sharpness of the fine projections of the roughened surface may be represented by Abbot-Firestone curve, and it has been found that the fading can be prevented if the cutting depth Cv is not more than 5 microns when the profile bearing length ratio $t_p$ on the curve is 5%.

Figure 11:
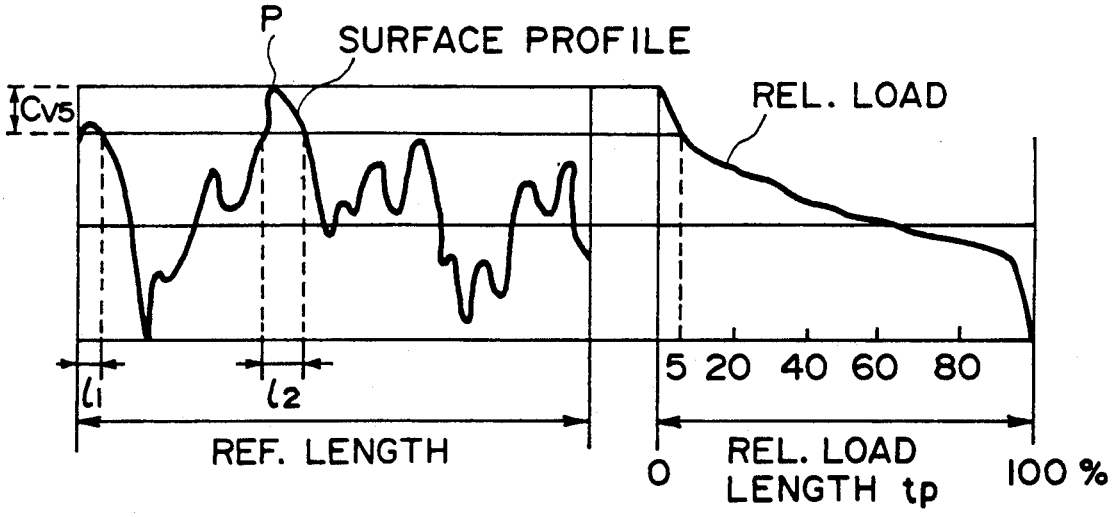
FIG. 11 is a bearing ratio curve.

FIG. 11 (left side), shows a profile (cross-section) of a reference length L on the developing sleeve surface (2.5 mm in this Specification), and it also shows at the right side the Abbot-Firestone curve corresponding to the profile.

In the profile of the reference length L of the developing sleeve surface, the profile of the reference length L is cut by a line parallel to an average line in the reference length L at a certain level Cv. The profile bearing length ratio $t_p$ at the level Cv is defined as a ratio (percentage) of a sum of the lines cut by the profile $\mathbf{1}_1+\mathbf{1}_2+\ldots\mathbf{1}_n$ to the reference length. The cutting depth is defined as the distance (microns) from the top peak of the profile in the reference length to the level Cv.

The bearing ratio curve shows the relation between the cutting depth Cv (microns) and the profile bearing length ratio $t_p$ (percent).

In the present invention, the cutting depth Cv when the profile bearing length $t_p$ is 5% in the Abbot-Firestone curve (in the Example of FIG. 11, $t_p=[(l_1+l_2)/L]\times 100=5\%$, is particularly noted. By selecting the cutting depth Cv so as to be not more than 5 microns for the surface resin layer of the . developing sleeve, the fading in the image was prevented.

The profile may be detected using Surfcorder SE-30H, available from Kosaka Laborarory, Ltd., Japan, which is a surface detecting device or a needle contact type.

The inventors' investigations have revealed that the cutting depth Cv when the profile bearing length ratio $t_p$ is 5% on the Abbot-Firestone curve, has a lot to do with the ratio of occurrence of the fading, and that the center line average roughness Ra (JIS B0601) of the developing sleeve surface is not so related with the occurrence ratio of the fading.

Table 2 shows an example of the results of investigations as to the relation among the cutting depth Cv, which will also called hereinafter "Cv5" when the profile bearing length ratio $t_p$ is 5% on the Abbot-Firestone curve, the center line average roughness Ra of the surface in accordance with JIS B0601, the surface slip property and the fading in the image developed.

TABLE 2

| | Sleeve (I) | Sleeve (II) |
|---|---|---|
| Cv5 | large (10 μm) | small (1.0 μm) |
| Ra | large (2.5 μm) | slightly large (2.0 μm) |
| Slip of sleeve surface | No good | Good |
| Fading | Yes | No |

Figure 10:
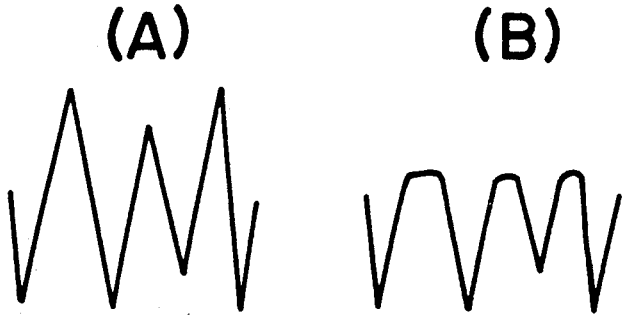
FIG. 10A is a schematic view of a surface of the outer coating layer in a conventional example.
FIG. 10B shows the same according to the present invention.

Developing sleeve I has Cv5=10 microns and Ra=2.5 microns, whereas the developing sleeve 2 is the same as the developing sleeve I with the exception that it is abraded on its surface, and has Cv5=1.0 micron and Ra=2.0 microns. As contrasted to the developing sleeve 1, the developing sleeve 2 showed significantly different Cv5, that is, 1.0, as contrasted to 10 microns, but the surface roughness Ra was not so different 2.0 microns, as compared with 2.5 microns. The difference in the surfaces of the developing sleeves I and II, will be understood, looking at the profiles. The developing sleeve I, as shown in FIG. 10A, has such a profile that the projections and pits are sharp with fine roughness, and therefore, Cv5 and Ra are both large. However, the developing sleeve 2, as shown in FIG. 10, has such a profile that the projections were round because of the surface abrasion, and therefore, the Cv5 is small. However, the pits of the profile of the developing sleeve II were not influenced by the surface abrasion, the level of the surface roughness Ra remained relatively large.

The fading phenomenon in the developing operation using the developing sleeves I and II will be described. In the case of the developing sleeve II, the surface projections are round and therefore, show good slipping property. Therefore, the developer can be conveyed against the confining force by the magnetic blade or the like by making the conveying force due to the electrostatic mirror force between the triboelectrically charged developer and the developing sleeve stronger than the conveying force due to the friction between the developer and the sleeve surface. Therefore, the developer layer is formed on the sleeve with the developer having high triboelectric charge providing the large mirror force. This is the reason why the fading is not produced. On the other hand, if the developing sleeve I has the surface sharp projection, the slip properties of the surface relative to the toner particles are not good As a result, the fading occurred.

As described in the foregoing, by properly selecting the Cv5 level of the developing sleeve surface, the slip property of the developing sleeve surface relative to the developer is improved. Thus, the fading can be prevented.

Figure 12:
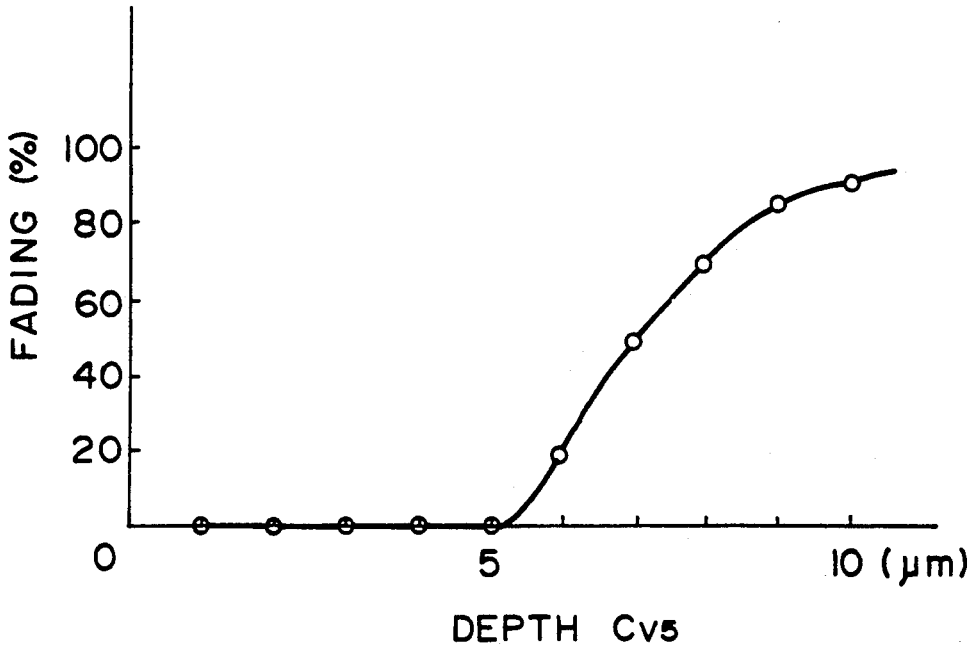
FIG. 12 is a graph of fading occurrence vs. cutting depth of the coating layer surface.

FIG. 12 is a graph of plots of the fading occurrence ratio when the cutting depth Cv5 in the Abbot-Firestone curve of the developing sleeve surface is changed. The occurrence ratio is determined as follows. A predetermined number 25 of prints are produced from a character pattern having the print duty of 4% using the developing device 10 shown in FIG. 4. One solid black image is printed. The fading occurrence ratio is the ratio of the occurrences of stripe-like non-uniformity (FIG. 3) and the thickness non-uniformity of the line of the character pattern, in the solid black image.

As will be understood from FIG. 12, the fading occurrence ratio is 0% when the cutting depth Cv5 is not more than 5 microns. If 5 microns $<$Cv5, the fading can occur. Around Cv5=10%, the fading occurrence ratio is as large as 90%. It will be understood, if the developing sleeve has Cv5$\leqq$5 microns, the occurrence of the fading in the image can be prevented.

Figure 13:
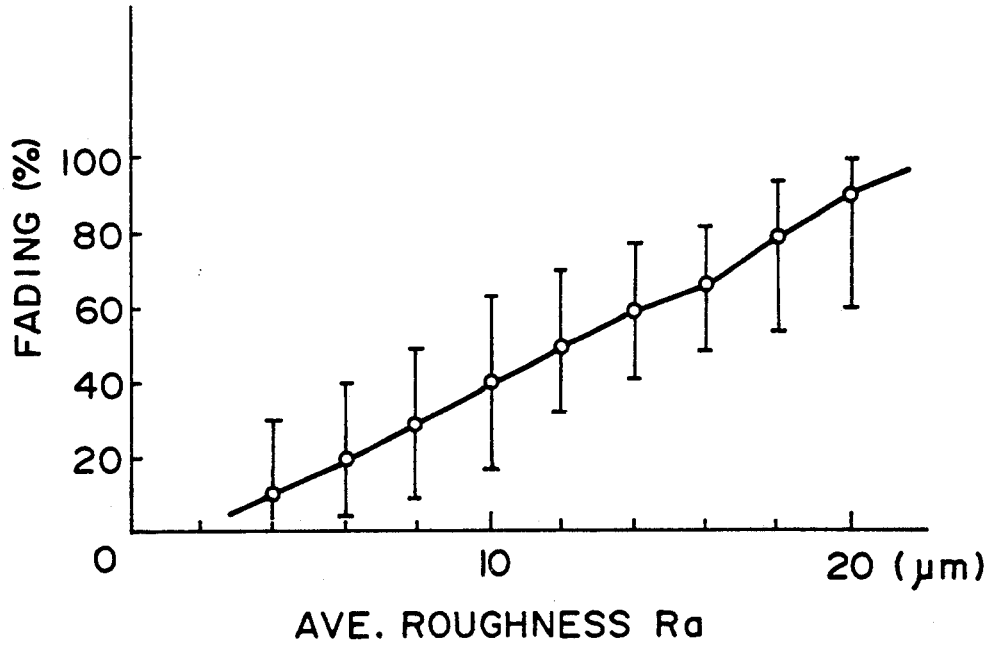
FIG. 13 is a graph of fading occurrence vs. surface roughness of the coating layer.

FIG. 13 is a graph showing the relation between the center line average roughness Ra of the developing sleeve and the fading occurrence ratio. The fading occurrence ratio decreases with the decrease of the center line average roughness Ra. The occurrence ratio of the fading varies significantly, and therefore, the roughness Ra does not correspond to the fading occurrence ratio.

However, if the roughness Ra is less than 0.4 micron, the image density becomes low due to the insufficient supply of the toner on the developing sleeve, and the non-uniformity of the developer layer thickness occurs, if the roughness Ra is less than 0.4 microns. Therefore, it is preferable that the roughness Ra is not less than 0.4 micron, further preferably, 0.5 micron. If the roughness Ra is too large, the amount of the triboelectric charge of the developer lowers with the result of non-uniformity of the developer layer thickness, so that the image quality is degraded. From this standpoint, the surface roughness Ra is preferably not more than 3.0 microns.

Figure 3:
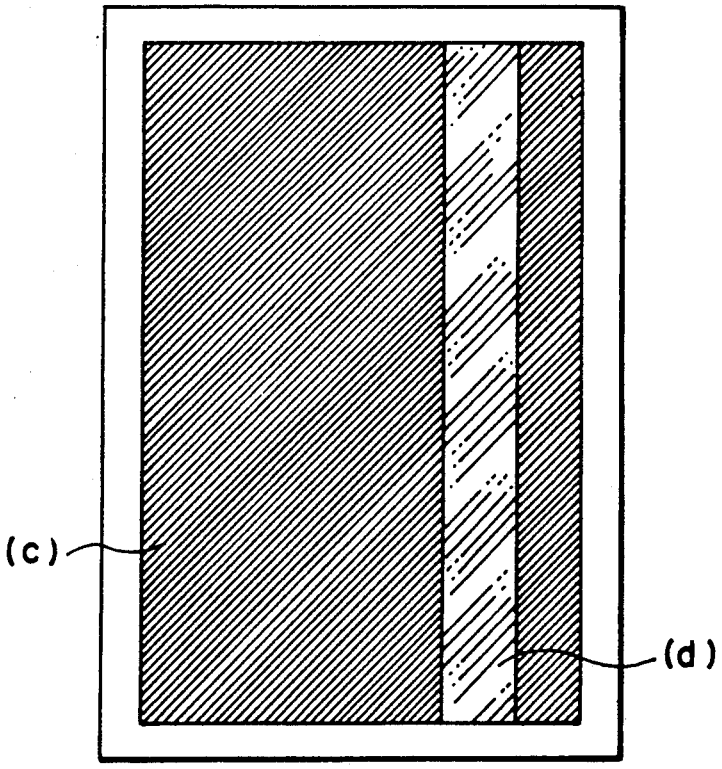
FIG. 3 illustrates a fading phenomenon.

In the sleeve A of Example 1, Cv5 is not more than 5 microns, and therefore, the fading shown in FIG. 3 did not occur in the developing apparatus (FIG. 4) using the sleeve A. This is because the fine projections on the resin layer surface were rounded by the sandblasting (the resin powder resulting from the abrasion by the sandblasting were removed by cleaning the developing sleeve in alcohol).

EXAMPLE 5

The resin liquid of Example 1 was applied, heated and cured on an aluminum tube. The resin layer as in Example 1 was provided. In Example 5, the surface of the resin layer was polished with felt.

The polishing process was as follows:

The developing sleeve on which the resin layer was cured was rotated at approximately 800 rpm, and the felt is contacted to the developing sleeve surface with the pressure of 1–3 kg. The felt was moved from one of the longitudinal ends of the developing sleeve to the other at a speed of 1–5 cm/sec. By doing so, the surface of the developing sleeve is polished, by which the resin layer 17 acquires the cutting depth Cv5 not more than 5 microns.

Figure 2:
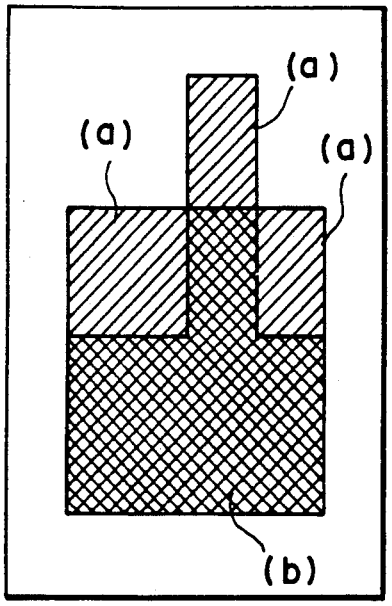
FIG. 2 illustrates the phenomenon of ghost image.

When the thus obtained developing sleeve was incorporated in the developing apparatus of FIG. 4. It was confirmed that the fading shown in FIG. 3 did not occur, that the ghost image shown in FIG. 2 did not occur, and that the developed image had high density.

The surface polishing of the developing sleeve is not made limitedly by the felt, but may be made by cloth or paper waste. In addition, the developing sleeve may be polished by hand without rotating it.

EXAMPLE 6

In Example 6, the resin liquid of Example 3 was applied and heat-cured on an aluminum tube, similarly to Example 3. The resin layer was polished as in Example 5 so as to provide the cutting depth Cv5 of not more than 5 microns. Using the sleeve 14 thus produced, the development operations were carried out in the apparatus of FIG. 4. It has been confirmed that the fading and the ghost image production is prevented, and that high density images are produced.

Particle size of the graphite was changed. The graphite was effective in the range of 0.3–7 microns whether it is artificial or natural.

In Examples 5 and 6, the surface of the developing sleeve 14 was polished by rubbing with a member not containing abrasive particles. However, similarly to Example 1, the sandblasting may be usable, if the cutting depth Cv5 is not more than 5 microns.

By the abrasion, the fine particles described in the foregoing are exposed substantially at the surface of the resin layer, so that the properties of the fine particles can be utilized advantageously.

In the foregoing embodiments, the binder resin of the conductive fine particle containing resin layer 17 on the developing sleeve 14 is phenol resin, but other resins are usable, including vinyl chloride, vinyl acetate, polymer of vinyl chloride and vinyl acetate, polyester, polystyrene, PMMA, cellulose acetate, butyral, melamine, epoxy resin, water base casein or the like. The resin is not limited to the heat-plastic or heat-curable materials, and UV (ultraviolet rays)-curable resin is usable. However, in the case of the UV-curable resin, the thickness of the coating is not made very large in consideration of the curing conditions. However, if it is used together with the heat-curable resin and the heat-plastic resins, the sufficiently thick layer can be produced.

The P/V ratio (fine particles/binder resin) was changed in the range of ½–2/1, and it was confirmed that the similar tendency was provided. If, however, the volume resistivity of the resin layer exceeds $10^2$ ohm-cm, the ghost image production and the developer charge-up are promoted.

In the foregoing embodiments, the resin layer 17 has been produced by spraying the resin liquid on the developing sleeve 14. The other methods such as dipping method, roller coating method or the like are usable. The blasting process may be carried out before the coating is cured. However, in this case, the blasting conditions are different from those when the blasting is carried out after the coating is cured.

Figure 14:
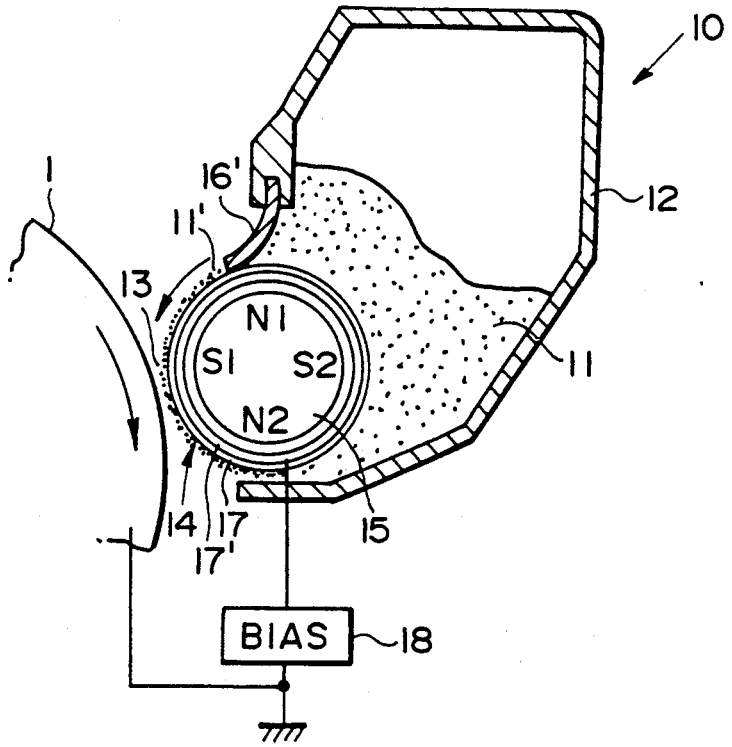
FIG. 14 is a sectional view according to another embodiment of the present invention.
Figure 15:
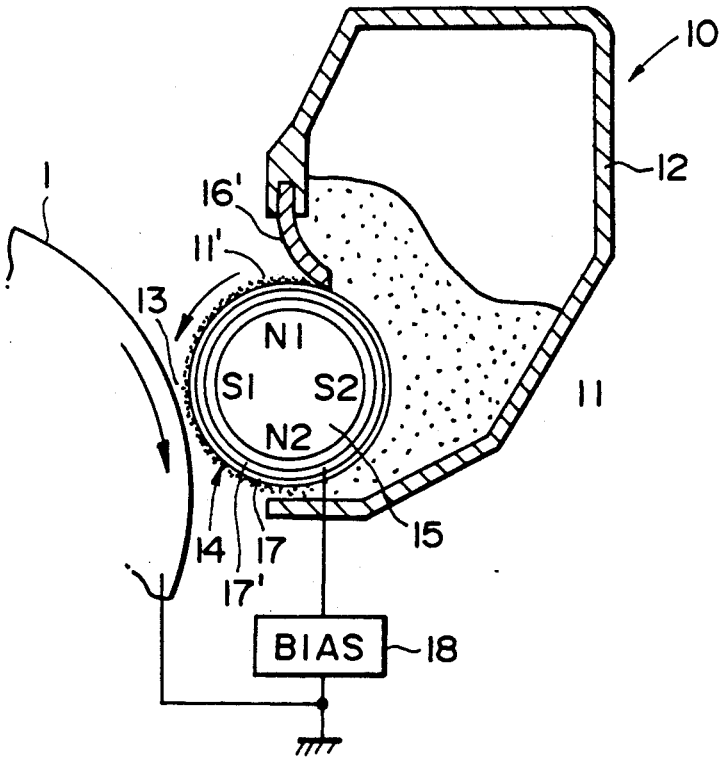
FIG. 15 is a sectional view of a developing apparatus according to a further embodiment of the present invention.

In FIG. 4, the layer thickness of the developer is regulated by the magnetic blade 16. However, as shown in FIGS. 14 and 15, the thickness of the conveyed developer layer 11' to be conveyed to the developing zone 13 may be regulated by an elastic blade 16' made of rubber or metal leaf spring. In FIG. 14, the blade 16' is contacted to the sleeve 14 codirectionally with the rotation of the sleeve 14. In FIG. 15, the blade 16' is contacted to the sleeve 14 counter-directionally with respect to the movement direction of the sleeve. The contacts are both elastic contacts. The developer is passed through the gap formed between the blade 16 and the sleeve 14 into a thin layer of developer. The thickness of the developer layer 11' is smaller than the minimum clearance between the sleeve 14 and the drum 1 in the developing zone 13.

By rubbing the developer on the sleeve 14 by the elastic blade 16', as in FIGS. 14 and 15 devices, the amount of triboelectric charge of the developer can be increased. Correspondingly, however, the fine particles of the developer tends to be extremely charged, and therefore, the present invention is particularly effective with such a developing device.

In addition, the present invention is applicable to an endless belt type developer carrying member as well as the above-described cylindrical sleeve. In the foregoing embodiments, the developer carrying member comprises the conductive base of metal coated with the resin layer. However, the developer carrying member may be entirely made of the same material as the resin layer, more particularly, by constituting the developer carrying member from its inside to the other side with the same resin material.

The present invention is applicable to a non-magnetic one component developer. The elastic blade shown in FIG. 14 or 15 is suitable to regulate the thickness of the non-magnetic one component developer.

In the foregoing embodiments, the sleeve is supplied with a bias voltage having an AC component, but may be supplied with a DC bias voltage not containing the AC component.

The present invention is applicable to a developing apparatus wherein the developer is triboelectrically charged to the positive polarity and to the developing apparatus wherein the developer is triboelectrically charged to the negative polarity. The present invention is applicable both to the regular developing apparatus or a reverse-developing apparatus.

While the invention has been described with reference to the structures disclosed herein, it is not confined to the details set forth and this application is intended to cover such modifications or changes as may come within the purposes of the improvements or the scope of the following claims.

What is claimed is:

1. A electrostatic latent image developing apparatus, comprising:

a movable developer carrying member for carrying developer to a developing zone where an electrostatic latent image on an image bearing member is developed; and an outer coating layer on said developer carrying member, in which said coating layer comprises resin in which conductive fine particles are dispersed and which is abraded by abrasive material not containing abrasive grain, and wherein a surface of the coating layer has a cutting depth Cv of not more than 5 microns where a profile bearing length ratio is 5% on a bearing ratio curve.

2. An apparatus according to claim 1, wherein the conductive fine particles include carbon fine particles.

3. An apparatus according to claim 1, wherein the conductive fine particles include graphite fine particles.

4. An apparatus according to claim 1, wherein the conductive fine particles include carbon fine particles and graphite fine particles.

5. An apparatus according to claims 1–4, wherein said coating layer has an outer surface having a center line average roughness Ra of 0.4–3 microns.

6. An apparatus according to claims 1–4, wherein said coating layer is abraded by at least one of felt cloth, paper, brush and skin.

7. An electrostatic latent image developing apparatus comprising:

a movable developer carrying member for carrying developer to a developing zone wherein an electrostatic latent image on an image bearing member is developed;

a coating layer on said developer carrying member, wherein said coating layer comprises a resin material in which fine particles are dispersed, and wherein a cutting depth Cv of an outer surface of said coating layer is not more than 5 microns where a profile bearing length ratio $t_p$ is 5% on a bearing ratio curve.

8. An apparatus according to claim 7, wherein the conductive fine particles include carbon fine particles.

9. An apparatus according to claim 7, wherein the conductive fine particles include graphite fine particles.

10. An apparatus according to claim 7, wherein the conductive fine particles include carbon fine particles and graphite fine particles.

11. An apparatus according to any one of claims 7–10, wherein said coating layer has an outer surface having a center line average roughness Ra of 0.4–3 microns.

12. An apparatus according to claim 11, wherein said fine coating layer is abraded.

13. An apparatus according to claim 12, wherein said coating layer is abraded by at least one of felt, cloth, paper, brush and skin.

14. An apparatus according to claim 11, wherein said coating layer is abraded by abrasive particles.

15. An electrostatic latent image developing apparatus comprising:

a movable developer carrying member for carrying a one component developer to a developing zone where an electrostatic latent image on an image bearing member is developed, wherein said developer carrying member is effective to triboelectrically charge the one component developer to a polarity for developing the latent image; and a regulating member for regulating a thickness of a layer of the developer to be conveyed by said developer carrying member to the developing zone to a thickness which is smaller than the minimum clearance between said image bearing member and said developer carrying member, wherein said developer carrying member has a coating layer thereon comprising a resin material in which conductive fine particles are dispersed and which is abraded by abrasive material not containing abrasive grain, and wherein a surface of the coating layer has a cutting depth Cv of not more than 5 microns where a profile bearing length ratio is 5% on a bearing ratio curve.

16. An apparatus according to claim 15, wherein the conductive fine particles include carbon fine particles.

17. An apparatus according to claim 15, wherein the conductive fine particles include graphite fine particles.

18. An apparatus according to claim 15, wherein the conductive fine particles include carbon fine particles and graphite fine particles.

19. An apparatus according to any one of claims 15–18, wherein said coating layer has an outer surface having a center line average roughness Ra of 0.4–3 microns.

20. An apparatus according to any one of claims 15–19, wherein said coating layer is abraded by at least one of felt, cloth, paper and skin.

21. An apparatus according to claim 19, further comprising a stationary magnet in said movable developer carrying member, wherein the one component developer is a magnetic developer, and said regulating member is a magnetic member disposed across said developer carrying member from a magnetic pole of said magnet.

22. An apparatus according to claim 19, wherein said regulating member is in contact with said developer carrying member.

23. An apparatus according to claim 22, wherein said regulating member includes an elastic blade.

24. An electrostatic latent image developing apparatus comprising:

a movable developer carrying member for carrying one component developer to a developing zone wherein an electrostatic latent image on an image bearing member is developed, said developer carrying member being effective to triboelectrically charge the one component developer to a polarity for developing the latent image; and a regulating member for regulating a thickness of a layer of the developer to be conveyed to the developing zone by said developer carrying member to a thickness which is smaller than a minimum clearance between the image bearing member and said developer carrying member, wherein said developer carrying member has a coating layer thereon comprising a resin material in which conductive fine particles are dispersed, and wherein a surface of the coating layer has a cutting depth Cv where a profile bearing length ratio is 5% on a bearing ratio curve, is not more than 5 microns.

25. An apparatus according to claim 24, wherein the conductive fine particles include carbon fine particles.

26. An apparatus according to claim 24, wherein the conductive fine particles include graphite fine particles.

27. An apparatus according to claim 24, wherein the conductive fine particles include carbon fine particles and graphite fine particles.

28. An apparatus according to any one of claims 24–27, wherein said coating layer has an outer surface having a center line average roughness Ra of 0.4–3 microns.

29. An apparatus according to claim 28, further comprising a stationary magnet in said movable developer carrying member, wherein the one component developer is a magnetic developer, and said regulating member is a magnetic member disposed across said developer carrying member from a magnetic pole of said magnet.

30. An apparatus according to claim 28, wherein said regulating member is in contact with said developer carrying member.

31. An apparatus according to claim 30, wherein said regulating member includes an elastic blade.

32. An apparatus according to claim 28, wherein said fine coating layer is abraded.

33. An apparatus according to claim 28, wherein said coating layer is abraded by at least one of felt, cloth, paper, brush and skin.

34. An apparatus according to claim 28, wherein said coating layer is abraded by abrasive particles.

35. An electrostatic latent image developing apparatus comprising:

a movable developer carrying member for carrying a one component developer to a developing zone wherein an electrostatic latent image on an image bearing member is developed, said developer carrying member being effective to triboelectrically charge the one component developer to a polarity for developing the latent image:

a regulating member for regulating a thickness of a layer of the developer to be conveyed to the developing zone by said developer carrying member; and a voltage source for applying a bias voltage to said developer carrying member, wherein said developer carrying member has a coating layer thereon comprising a resin material in which conductive fine particles are dispersed and which is abraded by abrasive material not containing abrasive grain, and wherein a surface of the coating layer has a cutting depth Cv of not more than 5 microns where a profile bearing length ratio is 5% on a bearing ratio curve.

36. An apparatus according to claim 35, wherein the conductive fine particles include carbon fine particles.

37. An apparatus according to claim 35, wherein the conductive fine particles include graphite fine particles.

38. An apparatus according to claim 35, wherein the conductive fine particles include carbon fine particles and graphite fine particles.

39. An apparatus according to any one of claims 35–38, wherein said voltage source applies to said developer carrying member a bias voltage having an AC component.

40. An apparatus according to claim 39, wherein said regulating member regulates a thickness of the developer layer to be conveyed to the developing zone to a thickness which is smaller than a clearance between said developer carrying member and the image bearing member.

41. An apparatus according to claim 40, wherein said coating layer has an outer surface having a center line average roughness Ra of 0.4–3 microns 42. An apparatus according to claim 41, wherein said coating layer is abraded by at least one of felt, cloth, paper, brush and skin.

43. An electrostatic latent image developing apparatus, comprising:

a movable developer carrying member for carrying one component developer to a developing zone wherein an electrostatic latent image on an image bearing member is developed, said developer carrying member being effective to triboelectrically charge the one component developer to a polarity for developing the latent image;

a regulating member for regulating a thickness of a layer of the developer to be conveyed to the developing zone by said developer carrying member; and a voltage source for applying a bias voltage to said developer carrying member, wherein said developer carrying member has a coating layer comprising a resin material in which conductive fine particles are dispersed, and wherein a surface of the coating layer has a cutting depth Cv where a profile bearing length ratio is 5% on a bearing ratio curve, is not more than 5 microns.

44. An apparatus according to claim 43, wherein the conductive fine particles include carbon fine particles.

45. An apparatus according to claim 43, wherein the conductive fine particles include graphite fine particles.

46. An apparatus according to claim 43, wherein the conductive fine particles include carbon fine particles and graphite fine particles.

47. An apparatus according to any one of claims 43–46, wherein said voltage source applies to said developer carrying member a bias voltage having an AC component.

48. An apparatus according to claim 47, wherein said regulating member regulates a thickness of the developer layer to be conveyed to the developing zone to a thickness which is smaller than a clearance between said developer carrying member and the image bearing member.

49. An apparatus according to claim 47, wherein said coating layer has an outer surface having a center line average roughness Ra of 0.4–3 microns.

50. An electrostatic latent image developing apparatus comprising:

a movable developer carrying member for carrying one component developer to a developing zone wherein an electrostatic latent image on an image bearing member is developed, said developer carrying member being effective to triboelectrically charge the one component developer to a polarity for developing the latent image;

a regulating member for regulating a thickness of a layer of the developer to be carried to the developing zone by said developer carrying member; and a voltage source for applying a bias voltage to skin developer carrying member, wherein said developer carrying member has a coating comprises a resin material in which conductive fine particles are dispersed and which is abraded, wherein a surface of the coating layer has a cutting depth Cv where a profile bearing length ratio $t_p$ is 5% on a bearing ratio curve, is not more than 5 microns.

51. An apparatus according to claim 50, wherein the conductive fine particles include carbon fine particles.

52. An apparatus according to claim 50, wherein the conductive fine particles include graphite fine particles.

53. An apparatus according to claim 50, wherein the conductive fine particles include carbon fine particles and graphite fine particles.

54. An apparatus according to any one of claims 50–53, wherein said voltage source applies to said developer carrying member a bias voltage having an AC component.

55. An apparatus according to claim 54, wherein said regulating member regulates a thickness of the developer layer to be conveyed to the developing zone to a thickness which is smaller than a clearance between said developer carrying member and the image bearing member.

56. An apparatus according to claim 55, wherein said coating layer has an outer surface having a center line average roughness Ra of 0.4–3 microns.

57. An apparatus according to claim 56, wherein said coating layer is abraded by at least one of felt, cloth, paper, brush and skin.

58. An apparatus according to claim 56, wherein the coating layer is abraded by abrasive particles.

59. A developer carrying member for carrying a one component developer to a developing zone where an electrostatic latent image on an image bearing member is developed, said developer carrying member comprising:

a base member; and an outer coating layer arranged on said base member, wherein said outer coating layer comprises a resin having fine conductive particles dispersed therein and abraded by abrasive material not containing abrasive grain, and wherein a surface of the coating layer has a cutting depth Cv of not more than 5 microns where a profile bearing length ratio is 5% on a bearing ratio curve.

60. A developer carrying member according to claim 59, wherein the fine conductive particles comprise fine carbon particles.

61. A developer carrying member according to claim 60, wherein the fine conductive particles comprise fine graphite particles.

62. A developer carrying member according to claim 60, wherein the fine conductive particles comprises fine carbon particles and fine graphite particles.

63. A developer carrying member according to any one of claims 60–62, wherein said outer coating layer comprises an outer surface having a center line average roughness between 0.4 and 3 microns.

64. A developer carrying member according to any one of claims 60–62, wherein said outer coating layer is abraded by at least one of felt, cloth, paper, brush and skin.

65. A developer carrying member for carrying a one component developer to a developing zone where an electrostatic latent image on an image bearing member is developed comprising:

a base member; and a coating layer arranged on said base member, wherein said coating layer comprises a resin material having fine conductive particles dispersed therein, and wherein said coating layer comprises a resin material having fine conductive particles dispersed therein, and wherein a cutting depth CV of an outer surface of said coating layer is at most 5 microns when the profile bearing length ratio $t_p$ is 5% on a bearing ratio curve.

66. A developer carrying member according to claim 65, wherein the fine conductive particles comprise fine carbon particles.

67. A developer carrying member according to claim 65, wherein the fine conductive particles comprise fine graphite particles.

68. A developer carrying member according to claim 65, wherein the fine conductive particles comprise fine carbon particles and fine graphite particles.

69. A developer carrying member according to any one of claims 65–68, wherein said coating layer comprises an outer surface having a center line having an average roughness between 0.4 and 3 microns.

70. A developer carrying member according to claim 69, wherein said coating layer is abraded.

71. A developer carrying member according to claim 70, wherein said coating layer is abraded by at least one of felt, cloth, paper, brush and skin.

72. A developer carrying member according to claim 70, wherein said coating layer is abraded by abrasive particles.

73. A developer carrying member for carrying a one component developer to a developing zone where an electrostatic latent image on an image bearing member is developed, wherein said developer carrying member is effective to triboelectrically charge the one component developer to a polarity for developing the latent image, said developer carrying member comprising a coating layer arranged thereon comprising a resin material having fine conductive particles dispersed therein and abraded by abrasive material not containing abrasive grain, and wherein a surface of the coating layer has a cutting depth Cv of not more than 5 microns where a profile length ratio is 5% on a bearing ratio curve.

74. A developer carrying member according to claim 73, wherein the fine conductive particles comprise fine carbon particles.

75. A developer carrying member according to claim 73, wherein the fine conductive particles comprise fine graphite particles.

76. A developer carrying member according to claim 73, wherein the fine conductive particles comprise fine carbon particles and fine graphite particles.

77. A developer carrying member according to any one of claims 73–76, wherein said coating layer comprises an outer surface having a center line average roughness between 0.4 and 3 microns.

78. A developer carrying member according to claim 77, wherein said coating layer is abraded by at least one of felt, cloth, paper, brush and skin.

79. A developer carrying member for carrying one component developer to a developing zone wherein an electrostatic latent image on an image bearing member is developed, wherein said developer carrying member is effective to triboelectrically charge the one component developer to a polarity for developing the latent image, said developer carrying member comprising a coating layer thereon which comprises a resin material having fine conductive particles being dispersed, and wherein a surface of the coating layer has a cutting length Cv when the profile bearing length ratio is 5% on a bearing ratio curve is at most 5 microns.

80. A developer carrying member according to claim 79, wherein the fine conductive particles comprise fine carbon particles.

81. A developer carrying member according to claim 79, wherein the fine conductive particles comprise graphite fine particles.

82. A developer carrying member according to claim 79, wherein the fine conductive particles comprise fine carbon particles and fine graphite particles.

83. A developer carrying member according to any one of claims 79–82, wherein said coating layer comprises an outer surface having a center line average roughness between 0.4 and 3 microns.

84. A developer carrying member according to claim 83, wherein said coating layer is abraded.

85. A developer carrying member according to claim 83, wherein said coating layer is abraded by at least one of felt, cloth, paper, brush and skin.

86. A developer carrying member according to claim 83, wherein said coating layer is abraded by abrasive particles.

* * * * *

UNITED STATES PATENT AND TRADEMARK OFFICE

CERTIFICATE OF CORRECTION

PATENT NO. : 5,185,496

DATED : February 9, 1993

INVENTOR(S) : NISHIMURA ET AL.

It is certified that error appears in the above-identified patent and that said Letters Patent is hereby corrected as shown below:

COLUMN 1

Line 16, "image" should be deleted.
Line 56, "a." should read --a--.

COLUMN 2

Line 12, "is" should read --are--.

COLUMN 3

Line 26, "tearing" should read --bearing--.
Line 48, "are" should read --is--.

COLUMN 4

Line 11, "exces-" should read --Exces- --.

COLUMN 6

Line 41, "another" should read --other--.
Line 57, "ohm.cm" should read --ohm-cm--.

COLUMN 8

Line 1, "GB#400" should read --FGB#400--.
Line 28, "are" should read --is--.

COLUMN 10

Line 26, "sleeve ;4" should read --sleeve 14--.

UNITED STATES PATENT AND TRADEMARK OFFICE

CERTIFICATE OF CORRECTION

PATENT NO. : 5,185,496

DATED : February 9, 1993

INVENTOR(S) : NISHIMURA ET AL.

It is certified that error appears in the above-identified patent and that said Letters Patent is hereby corrected as shown below:

COLUMN 11

Line 27, "." should be deleted.
Line 42, "also" should read --also be--.

COLUMN 12

Line 25, "good" should read --good.--.

COLUMN 13

Line 26, "FIG. 4. It" should read --FIG. 4, it--.

COLUMN 16

Line 29, "15-19," should read --15-18,--.

COLUMN 18

Line 3, "microns" should read --microns.--.
Line 60, "skin" should read --said--.
Line 63, "comprises" should read --comprising--.

COLUMN 19

Line 65, "said coating layer comprises a" should be deleted.
Line 66, line 66 should be deleted.
Line 67, "persed therein, and wherein" should be deleted.

UNITED STATES PATENT AND TRADEMARK OFFICE

CERTIFICATE OF CORRECTION

PATENT NO. : 5,185,496

DATED : February 9, 1993

INVENTOR(S) : NISHIMURA ET AL.

It is certified that error appears in the above-identified patent and that said Letters Patent is hereby corrected as shown below:

COLUMN 20

Line 36, "profile" should read --profile bearing--.
Line 64, "length" should read --depth--.

Signed and Sealed this

First Day of March, 1994

Bruce Lehman

*Attest:*

BRUCE LEHMAN

*Attesting Officer*

*Commissioner of Patents and Trademarks*